US005538401A

United States Patent [19]

Schaffner et al.

[11] Patent Number: 5,538,401

[45] Date of Patent: Jul. 23, 1996

[54] AXIAL PISTON PUMP

[75] Inventors: Larey D. Schaffner, Baltimore; Lawrence R. Geise, Columbus; Jack W. Wilcox, Columbus; Ellis H. Born, Columbus, all of Ohio

[73] Assignee: Denison Hydraulics Inc., Marysville, Ohio

[21] Appl. No.: 270,473

[22] Filed: Jul. 5, 1994

[51] Int. Cl.[6] ..... F04B 1/26

[52] U.S. Cl. ..... 417/222.1; 417/269; 92/57

[58] Field of Search ..... 417/222.1, 269; 92/57; 91/499

[56] References Cited

U.S. PATENT DOCUMENTS 3,699,845 10/1972 Ifield ..... 91/499
4,520,712 6/1985 Havorka et al. ..... 91/499
4,668,171 5/1987 Beutler et al. ..... 417/222.1
4,934,251 6/1990 Barker ..... 91/499
5,363,740 11/1994 Coakley ..... 417/269

FOREIGN PATENT DOCUMENTS 1498937 8/1989 U.S.S.R. ..... 417/222.1

*Primary Examiner*—Charles Freay
*Attorney, Agent, or Firm*—Thomas S. Baker, Jr.

[57] ABSTRACT

A variable displacement axial piston pump has a plurality of piston bores each connected to an inwardly angled fill port. The fill ports extend from the piston bores inwardly to the working face of the barrel to reduce the diameter of the fill circle of a pump. This decreases the velocity that must be attained by incoming fluid to thereby increase the operating speed at which the pump may be driven where the pump is filled at atmospheric pressure.

21 Claims, 5 Drawing Sheets

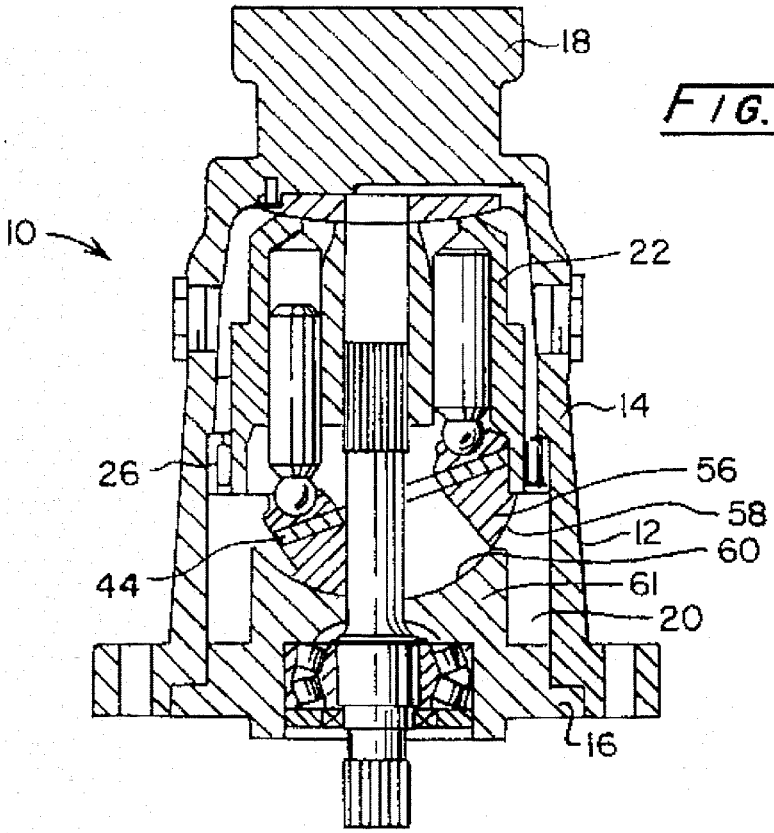
FIG. 4
FIG. 5
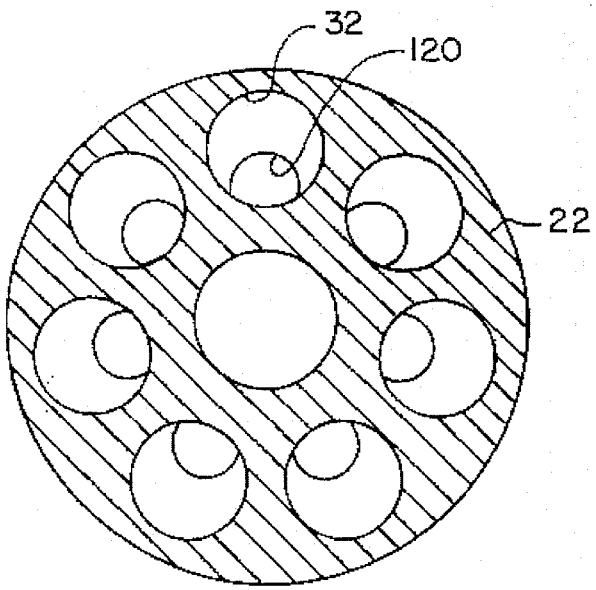

AXIAL PISTON PUMP

BACKGROUND OF THE INVENTION

There has been a demand for variable displacement axial piston hydraulic pumps which can deliver increased power, which can operate at typical electric motor speeds such as 1800 rpm, which are quiet and which utilize inlet fluid at atmospheric pressure. One of the main limiting factors as to the speed at which an axial piston pump may be run is the speed at which fluid at the inlet port fills the piston bores during the pumping operation. If the bores are not filled with fluid as they traverse the inlet port, cavitation occurs, power is lost and severe damage to the pump may occur. Traditionally, users have added boost pumps or otherwise acted to pressurize the fluid at the pump inlet in order to increase the filling speed of the pump and thereby increase the speed at which the pump may be operated.

Serious disadvantages occur when a boost pump or other pressurization means is utilized to increase the pressure of fluid at the inlet port. Such pressure boost systems increase the energy requirements of the hydraulic system thereby decreasing the overall efficiency of the system. Boost systems also adversely affect the operating environment of the hydraulic system in that they increase the overall noise level of the system. In many industrial applications, boost systems are not desired because of increased system costs, complexity, maintenance, difficulty of installation and noise.

The instant invention enables a variable displacement, axial piston pump to operate at a reduced noise level while being driven at relatively high electric motor speeds utilizing inlet fluid at atmospheric pressure. It has been found that in order for inlet fluid to enter the piston bores of a piston pump, the fluid must accelerate to the vector sum of the velocity of the pump inlet ports which rotate along a porting circle (tangential velocity) plus the axial velocity into the pump port. The tangential velocity (feet per second) component may be calculated utilizing the formula N (rpm) divided by 60 multiplied by bore circle diameter (ft.) multiplied by pi (3.14159). In this formula the piston bore circle diameter is equal to the diameter of the porting circle. In the axial piston pump of the instant invention the speed which must be attained by incoming pump fluid has been reduced by reducing the tangential velocity component thereof. This has been accomplished by effectively reducing the diameter of the porting circle. Additionally, Applicant's instant invention uniquely provides a velocity boost to incoming pump fluid by utilizing centrifugal force to further increase the rate at which incoming fluid reaches the velocity of the piston circle. Furthermore, the pump of the instant invention has a port plate designated to reduce the fluid shock and attendant noise which occurs as a piston bore moves from an inlet port to an outlet port and from an outlet port to an inlet port.

In the axial piston pump of the instant invention a barrel bearing affixed to the outer surface of the barrel rotatably mounts the barrel in the pump housing. With this design radial loads which necessarily occur in an axial piston pump from the pumping forces are absorbed by the barrel bearing. In contrast to this design, other axial piston pumps utilize a large, stiff shaft, supported at each end by bearings, which extends through the center of the cylinder barrel to provide support. With this design, radial loads and torque loads from driving the barrel are imposed on the shaft. This requires that the shaft have a relatively large diameter. Removing the barrel support from the shaft through the use of a barrel bearing permits the use of a smaller diameter drive shaft which in turn allows the piston circle i.e. the circle which contains the equal spaced piston cylinder bores in the cylinder barrel to be smaller in diameter. Where the piston circle is the same as the porting circle, the reduced piston circle diameter lowers the tangential velocity component required of the incoming fluid and thus permits the pump to fill at a higher rotational speed.

Applicants have reduced the required tangential velocity component of incoming fluid by reducing the effective porting circle diameter through the use of inwardly angled fill ports. The ports are in fluid communication with the piston bores and have a fill end which opens into the working face of the barrel along a fill circle having a smaller diameter than the piston circle. It has been found that because the fill port circle and the piston circle are different diameters an unbalanced force moment is created which tends to tip the barrel. This moment creates a radial force which is taken by the barrel bearing.

SUMMARY OF THE INVENTION

A variable displacement axial piston machine has a body, a barrel having a concave working face and a barrel bearing mounted in the body which surrounds and rotatably supports the barrel in the body. A drive shaft mounted in a drive shaft bore formed within the barrel acts to rotate the barrel. A plurality of piston bores are formed in the barrel along the circumference of a piston circle. A piston is mounted in each of the piston bores. A cam support is formed in the body and rotatably mounts a cam. The cam has a thrust plate mounted thereon. A shoe pivotally attached to each piston and slidable on the thrust plate reciprocates the pistons within the piston bores when the barrel is rotated. A pivot means pivots the cam between a position of minimum fluid displacement on the machine and a position of maximum fluid displacement of the machine. A plurality of angled fill ports are formed in the barrel each fill port having a first end in fluid communication with a piston bore and a fill end which opens into the working face of the barrel. The fill ends of the fill ports are positioned along the circumference of a fill circle which lies within the piston circle. A port block having a fluid inlet and a fluid outlet is affixed to the housing. A port plate is interposed between the working face of the barrel and the port block and has a convexed port face positioned adjacent the working barrel face. The port plate has an arcuate inlet port and an arcuate outlet port arranged along the circumference of the circle and aligned with the fluid inlet and fluid outlet respectively of the port block. The inlet and outlet ports of the port plate are formed along the circumference of the fill circles and are aligned with the fill ends of the fill ports.

DESCRIPTION OF THE DRAWINGS

FIG. 4 is a view along line 4—4 of FIG. 3;

FIG. 5 is a view of the barrel side of the port plate;

DESCRIPTION OF THE PREFERRED EMBODIMENT

Figure 1:
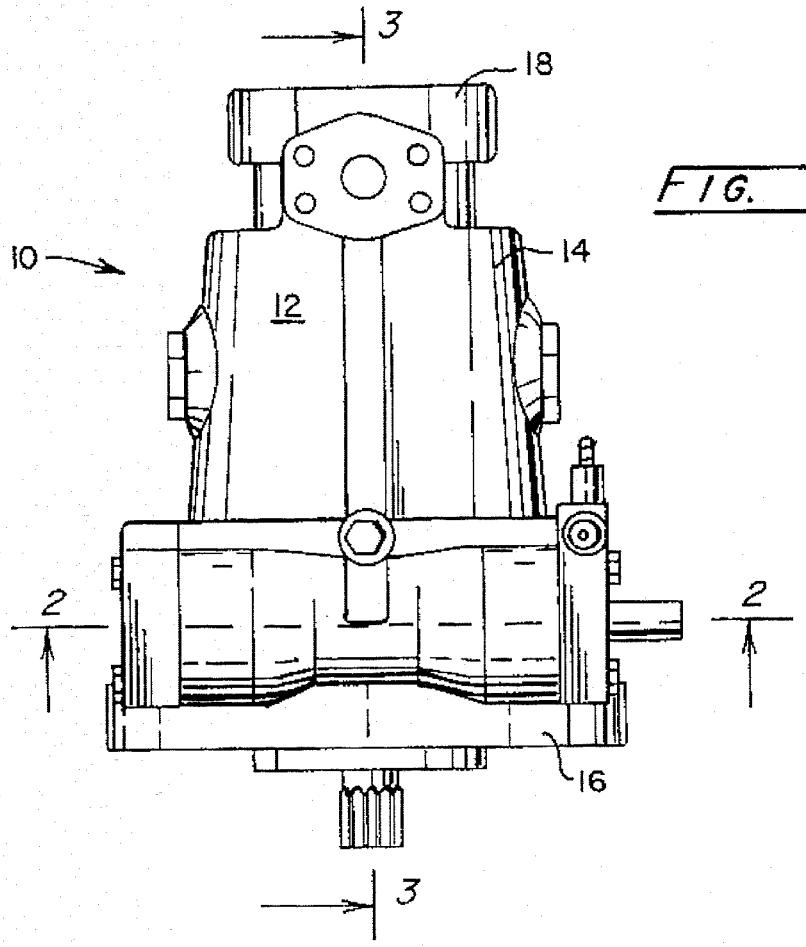
FIG. 1 is a plan view of the axial piston pump of the instant invention.

Referring to FIGS. 1 through 4, it may be observed that the axial piston pump (10) of the instant invention has a casing (12) comprised of a central cylindrical body (14), an end cap (16) affixed to one end of body (14) and a port block (18) affixed to the opposite end of body (14). Casing (12) defines an internal cavity (20) which houses the operating mechanism of the pump (10) which next will be described.

Figure 3:
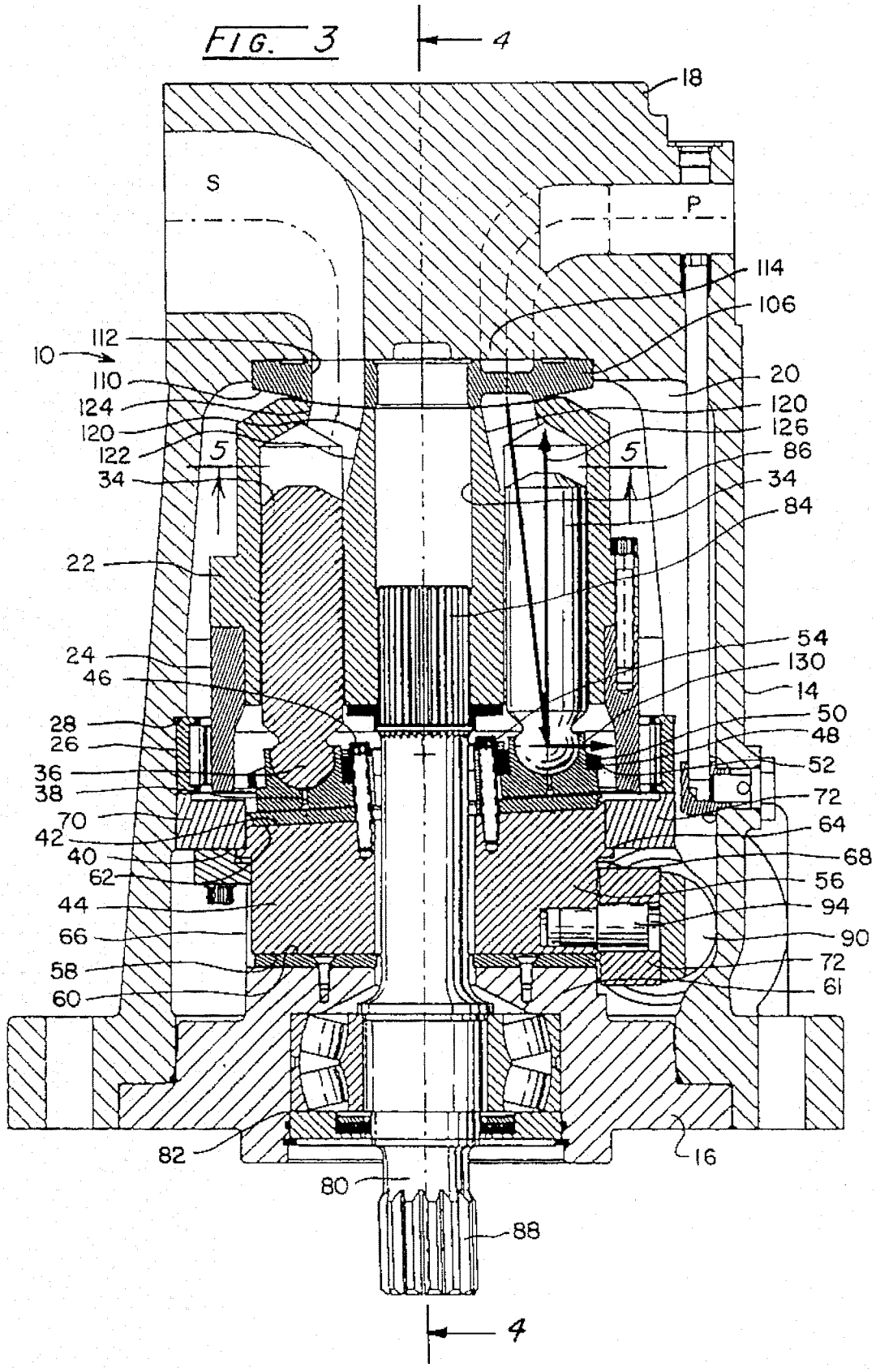
FIG. 3 is an enlarged view along line 3—3 of FIG. 1.

Turning to FIGS. 3 and 4, it may be seen that a barrel (22) has a cylindrical outer surface (24) mounted within the inner race of a roller bearing assembly (26) which in turn is mounted within body member (14). Bearing assembly (26) is located within body member (14) by a shoulder (28) on one side of the bearing and a retainer ring, not shown, on the opposite side of the assembly.

Barrel (22) contains a plurality of parallel cylindrical piston bores (32) which are equally spaced circumferentially about a piston or bore circle and are aligned parallel with the axis of rotation of barrel (22). Pump (10) of the instant invention contains seven piston bores (32). However, the subject invention applies equally to pumps having more or less piston bores.

A piston (34) resides within each piston bore (32). Each piston has a spherical head (36) at one end thereof which is received within a complementary cavity contained within a shoe (38) for pivotal attachment thereto. Each shoe (38) also has a flat sliding surface (40) adapted to be clamped against a complementary flat surface (42) formed on the surface of a swash plate (44). The shoes (38) are clamped against swash plate (44) by a retainer assembly (46). The assembly comprises a shoe retainer plate (48) having a plurality of openings (50) which are large enough to pass over the outer surface of the pistons (34) and small enough to engage a shoulder (52) formed on each shoe (38). A plurality of bolts (54) pass through retainer plate (48) into a rocker cam (56) and draw the plate towards swash plate (44) to clamp the piston shoes (38) therebetween in a well known manner.

Swash plate (44) mounts on a rocker cam (56) which is pivotally mounted within end cap (16). Rocker cam (56) has a semi-cylindrical rear surface (58) which is received within a complementary shaped surface (60) of a rocker cam cradle (61) formed in end cap (16).

A shoulder (62 and 64) projects laterally from each side wall (66 and 68) respectively of rocker cam (56). Retainers (70 and 72) engage shoulders (62 and 64) respectively to position the rear surface (58) of rocker cam (56) against the complementary surface (60) formed in the rocker cam cradle (61). It has been found that a reduction in pump noise occurs if the retainers (70 and 72) are formed from a hard plastic material as opposed to a metallic material. Of course, either functions to position the rocker cam (56) against the rocker cradle (61).

A drive shaft (80) is rotatably mounted within a spherical roller bearing assembly (82) mounted in end cap (16). A splined end (84) of shaft (80) projects into a complementary splined central bore (86) formed in barrel (22). The outer end (88) of drive shaft (80) is adapted to be attached to a prime mover such as an electric motor which rotates drive shaft (80) within spherical bearing (82) and barrel (22) within roller bearing assembly (26). When this occurs the shoes (38) at each end of the pistons (34) slide across the surface of swash plate (44) to thereby reciprocate the pistons within the bores (32) provided swash plate (44) is not perpendicular to the axis of rotation of barrel (22). Rocker cam (56) is rotatable between a position of minimum fluid displacement which occurs when swash plate (44) is perpendicular to the axis of rotation of barrel (22) and a position of maximum fluid displacement which occurs when it is at a maximum angle with respect to the axis of rotation of barrel (22).

Figure 2:
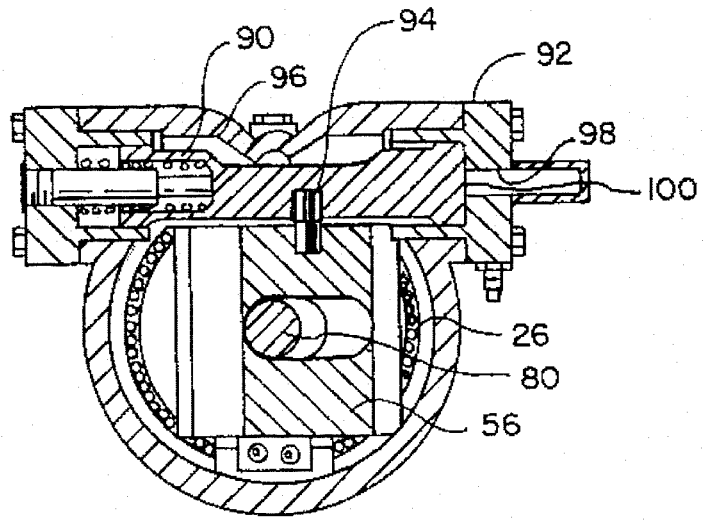
FIG. 2 is a view along line 2—2 of FIG. 1.

A pressure compensator mechanism (90) shown in FIGS. 2 and 3 sets the displacement of pump (10) in a well known manner. Compensator mechanism (90) has a control piston (92) connected to rocker cam (56) through a pin (94). Referring to FIG. 2, it may be observed that axial movement of control piston (92) causes corresponding rotational movement of rocker cam (56). A spring (96) in compensator mechanism (90) biases the control piston (92) to one extreme position in which the rocker cam is pivoted to the position of maximum fluid displacement as illustrated in FIG. 2. When the pressure in the pump outlet exceeds the setting of pressure compensator mechanism (90), the mechanism supplies high pressure fluid to a fluid passage (98) where it acts on the end (100) of control piston (92) to overcome the force of spring (96) and move the piston away from said one extreme position. Simultaneous rotation of rocker cam (56) to a shallower angle and a position of less fluid displacement occurs as the control piston (92) moves away from said one extreme position. Spring (96) again forces control piston (92) towards the one extreme position of increased fluid displacement in a well known manner when the working fluid pressure falls below the setting of compensator mechanism (90).

Figure 6:
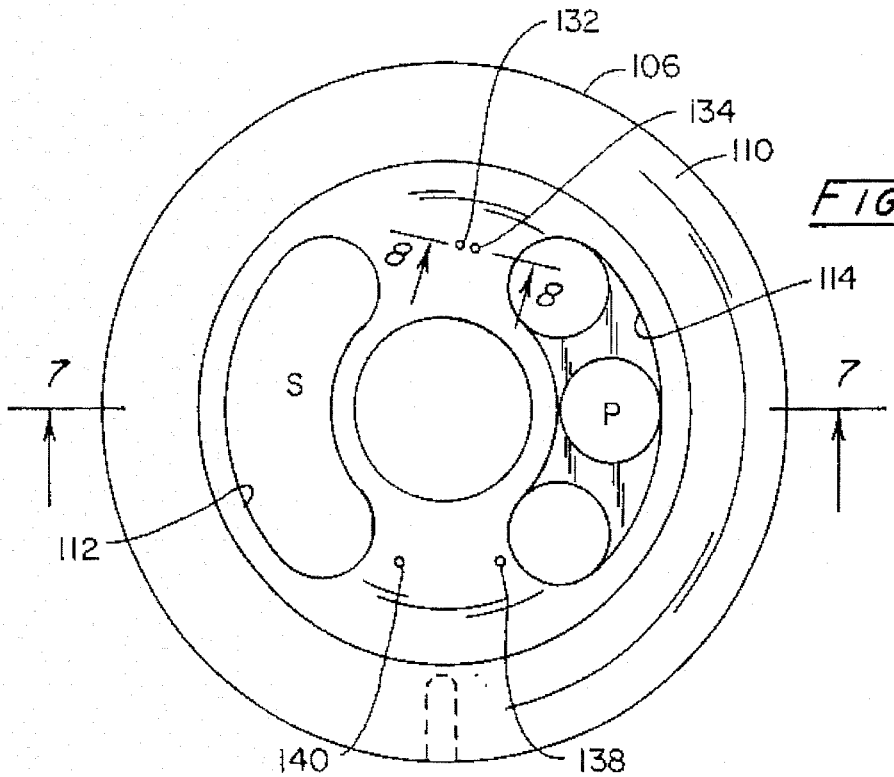
FIG. 6 is a view of the port block.
Figure 7:
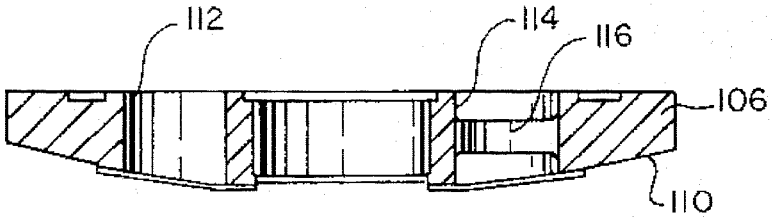
FIG. 7 is a view along line 7—7 of FIG. 6.

Referring again to FIG. 3, it may be observed that port block (18) has a pair of passages one of which defines an inlet or suction port S which provides inlet fluid at atmospheric pressure to the pump and an outlet or pressure port P which receives pressurized fluid from the pump. From FIG. 3 it may be seen that a port plate (106) is interposed between port block (18) and a concave working face (108) of barrel (22). Turning to FIGS. 3 and 6, it may be observed that port plate (106) has a convex port face (110) which contains an arcuate suction port (112) and an arcuate pressure port (114) arranged along the circumference of the circle aligned with the fluid inlet port S and the fluid outlet port P of port block (18). Port plate face (110) which engages working face (108) of barrel (22) has a convex surface.

From FIG. 3 it may be observed that the arcuate suction and pressure ports (112 and 114) defined within port plate (106) are contained within the circumference of a fill circle having a diameter somewhat less than that of the circle containing the piston bores (32) defined within barrel (22). Obviously, the piston bores (32) must be in fluid communication with the arcuate suction and pressure ports (112 and 114) respectively for the pump to operate. Again referring to FIG. 3 it may be observed that a plurality of angled fill ports corresponding to the number of piston bores (32) are formed within barrel (22). Each fill port (120) has one end (122) in fluid communication with a piston bore (32) and a fill end (124) which opens into the working face (108) of barrel (22). The fill port (120) are angled inwardly from end (122) to fill end (124) towards drive shaft (80). Consequently, the piston bores (32) are placed in fluid communication with the suction and pressure ports (112 and 114) in port plate (106) which extend along the circumference of a fill circle which lies inwardly of the piston circle of piston bores (32).

The pumping forces which occur during operation of pump (10) are depicted by arrows in FIG. 3. As piston (34) is driven towards the working face (108) of barrel (22) to expel pressurized fluid into fill port (120) and pressure ports (114 and P) a force along the axis of the piston denoted by arrow (126) is applied to port plate (106). This force is counteracted by a force along the axis of fill port (120)

having a direction depicted by arrow (128). The convex port face (110), the port plate (106) and the concave working face (108) of barrel (22) define the direction of the reaction force depicted by arrow (128). Because the force in fill port (120) is offset from the axis of piston (34), a resultant lateral thrust is applied to the piston (34) which acts through the axis of the spherical head (36) of piston (34). This lateral component force is indicated by arrow (130) and is applied directly in line with the center of barrel roller bearing assembly (26). From this, it may be observed that all lateral pumping forces are absorbed by bearing assembly (26).

Figure 8:
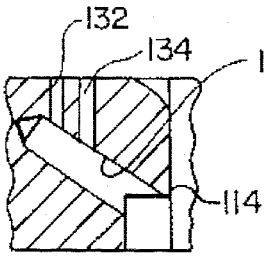
FIG. 8 is a view along line 8—8 of FIG. 6.
Figure 9:
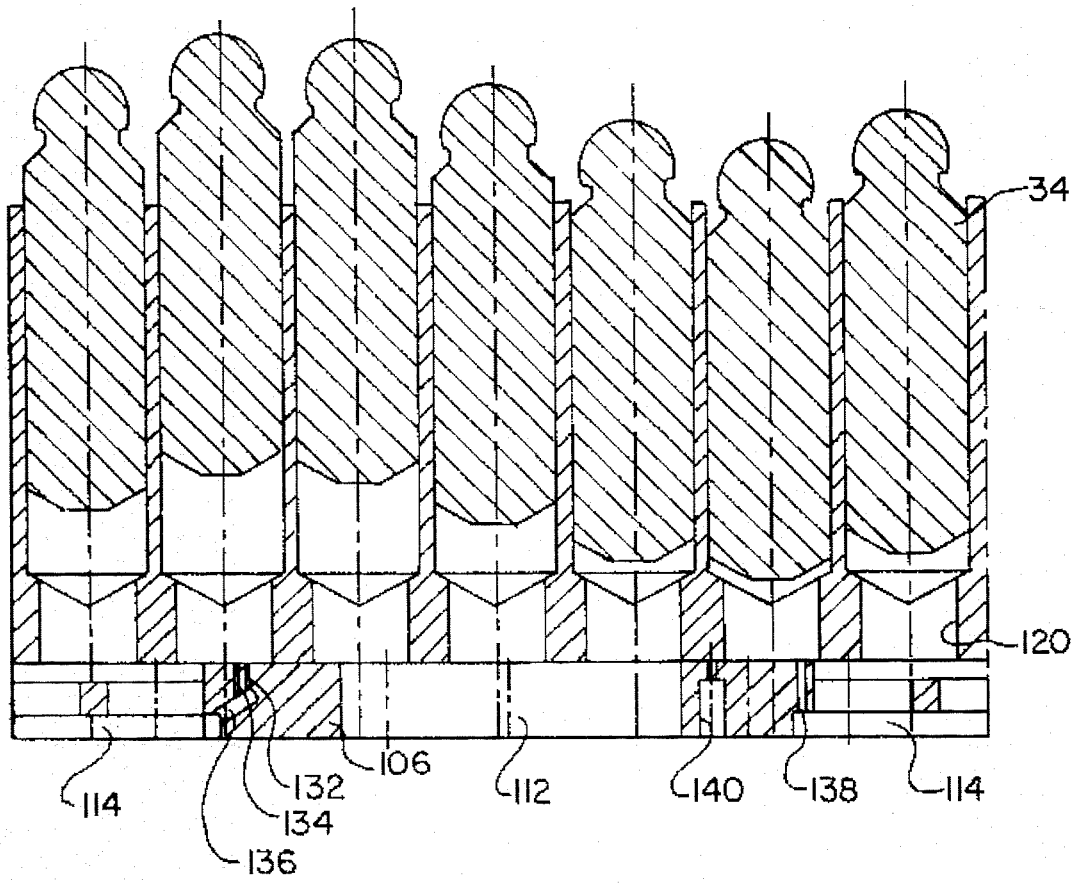
FIG. 9 is a diagram showing the position of a piston in its bore with respect to the ports in the port plate through one revolution of the barrel.

Turning to FIGS. 6, 8 and 9, it may be observed that a pair of small diameter closely spaced bleed bores (132 and 134) connected to an angled passage (136) are formed in port plate (106). The bleed bores (132 and 134) are aligned with the fill ends (124) of the fill ports (120) of the pump. Passage (136) opens into pressure port (114). The small diameter bleed bores (132 and 134) provide a staged transition for the fluid in the piston bores (32) as the bores move from the suction port (112) where they receive inlet fluid towards the pressure port (114) where they are exposed to the working pressure fluid.

It has been found that utilizing staged bleed bores as opposed to traditional elongated bleed slots prevents erosion of the barrel working face which has been common opposite the space where bleed slots have been utilized. It has been theorized that erosion of the barrel working face does not occur where staged bleed bores are utilized because the acceleration of the fluid does not occur instantaneously when the bores are uncovered as the piston bores pass over them and hence erosion of the barrel working face does not occur. We have found that the time required for pressure fluid to enter the piston bores through bleed bores (132 and 134) and the acceleration of the fluid may be controlled by adjusting the length and diameter of the bores. Exposing the piston bores (32) to working pressure fluid utilizing the adjacent staged bleed bores (132 and 134) during the transition from exposure to inlet pressure fluid to exposure of working pressure fluid provides a marked decrease in pump noise with little or no loss of pump efficiency.

Turning again to FIGS. 6 and 9, it may be seen that a pair of bores (138 and 140) are formed in the port plate between the pressure and suction ports (114 and 112) opposite the placement of bores (132 and 134). Bore (138) opens to the pressure port (114) whereas bore (140) opens to case (atmospheric pressure). At first glance it would appear that port (138) simply functions to extend the time the fill port (120) is in fluid communication with the pressure port (114). In fact this does occur. Also, the bores (138 and 140) in port plate (106) are timed such that the fill port (120) remains in fluid communication with bore (138) at the same time it opens to bore (140). This occurs as piston (34) begins its inward travel away from fill port (120) immediately before opening into inlet port (112). Inasmuch as bore (140) opens to case, any shock or energy in the port (120) is dissipated before the fill port (120) opens to the inlet or suction port S. It is believed that exposing fill port (120) simultaneously to bore (138) containing working pressure fluid and bore (140) open to case results in a blending of the incoming and outgoing fluid which substantially reduces turbulence within the port (120). As a result, the addition of these ports to the port plate (106) have been found to substantially reduce the noise level of the pump (10). In some instances the noise reduction has been as much as 3 decibels.

Although the above preferred embodiment of the invention describes a pressure compensated, variable displacement, axial piston pump, it should be noted that the subject invention also works in conjunction with variable displacement pumps controlled by a mechanism other than a pressure compensator and with fixed displacement pumps in which the swash plate is set or mounted at a fixed angle within the pump body. In a fixed displacement pump there is no pivotal rocker cam which moves within the pump body to change the angle of the swash plate and thereby change the displacement of the pump.

Since certain changes may be made to the above-described structure and method without departing from the scope of the invention herein it is intended that all matter contained in the description thereof or shown in the accompanying drawings shall be interpreted as illustrative and not in a limiting sense.

We claim our invention as follows:

1. A variable displacement hydraulic axial piston machine comprising:

a body;

a barrel having a concave working face;

a barrel bearing mounted in said body which surrounds and rotatably mounts said barrel in said body;

a drive shaft mounted in a drive shaft bore formed in said barrel for rotating said barrel;

a plurality of piston bores formed in said barrel positioned along the circumference of a piston circle;

a plurality of pistons of which one is mounted in each piston bore;

a cam support formed in said body;

a cam rotatably mounted in said cam support;

a thrust plate mounted on said cam;

a shoe pivotably attached to each piston and slideable on said thrust plate to reciprocate said pistons within said piston bores when said barrel is rotated;

pivot means for pivoting said cam between a position of minimum fluid displacement of the machine and a position of maximum fluid displacement of the machine;

a plurality of angled fill ports formed in said barrel each fill port having a first end in fluid communication with a piston bore and a fill end which opens into the working face of said barrel;

wherein said fill ends of said fill ports are positioned along the circumference of a fill circle which lies within said piston circle;

a port block having a fluid inlet and a fluid outlet affixed to said housing;

a port plate interposed between the working face of said barrel and said port block and having a convex port face positioned adjacent said barrel working face;

wherein said port plate has an arcuate inlet port and an arcuate outlet port arranged along the circumference of a circle and aligned with said fluid inlet and said fluid outlet respectively of said port block;

wherein said inlet and outlet ports of said port plate are formed along the circumference of said fill circle and aligned with said fill ends of said fill ports; and said barrel bearing overlies the pivot axes for said piston shoes, said pistons exert pumping forces parallel to the axis of said piston bores, said port plate exerts balancing forces which counteract said pumping forces at the fill ends of said fill ports, and said balancing forces extends along an axis which passes through said fill ports and said piston shoe pivot axes, wherein said balancing forces have a first force component parallel to said piston bore axes and a second force component perpendicular to said piston bore axes and said second force component is resisted by said barrel bearing.

2. The piston machine of claim 1 further comprising a pair of bleed bores formed in said port plate between said fluid inlet port and said fluid outlet port and having one end which opens into said port face and an other end which is in fluid communication with said fluid outlet port, wherein said fill ports traverse said bleed bores subsequent to traversing said fluid inlet port and prior to traversing said fluid outlet port to provide a staged transition for fluid in said fill ports as said fill ports move from fluid communication with said fluid inlet port to fluid communication with said fluid outlet port.

3. The piston machine of claim 2 further comprising a first bleed opening formed in said port plate between said fluid inlet port and said fluid outlet port and having one end which opens into said port face and an other end which is in fluid communication with said fluid outlet port and a second bleed opening formed in said port plate downstream of said first bleed port having one end which opens into said port face and an other end which opens to case wherein said fill ports traverse said first and second bleed openings in sequence subsequent to traversing said fluid outlet port and prior to traversing said fluid inlet port to reduce the turbulence in said fill ports as said fill ports move from fluid communication with said fluid outlet port to fluid communication with said fluid inlet port.

4. The piston machine of claim 1 further comprising a first bleed opening formed in said port plate between said fluid inlet port and said fluid outlet port and having one end which opens into said port face and an other end which is in fluid communication with said fluid outlet port and a second bleed opening formed in said port plate downstream of said first bleed port having one end which opens into said port face and an other end which opens to case wherein said fill ports traverse said first and second bleed openings in sequence subsequent to traversing said fluid outlet port and prior to traversing said fluid inlet port to reduce the turbulence in said fill ports as said fill ports move from fluid communication with said fluid outlet port to fluid communication with said fluid inlet port.

5. A variable displacement hydraulic axial piston machine comprising:

a body;

a barrel having a concave working face;

a barrel bearing mounted in said body which surrounds and rotatably mounts said barrel in said body;

a drive shaft mounted in a drive shaft bore formed in said barrel for rotating said barrel;

a plurality of piston bores formed in said barrel positioned along the circumference of a piston circle;

a plurality of pistons of which one is mounted in each piston bore;

a cam support formed in said body;

a cam rotatably mounted in said cam support;

a thrust plate mounted on said cam;

a shoe pivotably attached to each piston and slideable on said thrust plate to reciprocate said pistons within said piston bores when said barrel is rotated;

pivot means for pivoting said cam between a position of minimum fluid displacement of the machine and a position of maximum fluid displacement of the machine;

a plurality of angled fill ports formed in said barrel each fill port having a first end in fluid communication with a piston bore and a fill end which opens into the working face of said barrel;

wherein said fill ends of said fill ports are positioned along the circumference of a fill circle which lies within said piston circle;

a port block having a fluid inlet and a fluid outlet affixed to said housing;

a port plate interposed between the working face of said barrel and said port block and having a convex port face positioned adjacent said barrel working face;

wherein said port plate has an arcuate inlet port and an arcuate outlet port arranged along the circumference of a circle and aligned with said fluid inlet and said fluid outlet respectively of said port block;

wherein said inlet and outlet ports of said port plate are formed along the circumference of said fill circle and aligned with said fill ends of said fill ports;

a pair of bleed bores formed in said port plate between said fluid inlet port and said fluid outlet port each having one end which opens into said port face and an other end which is in fluid communication with said fluid outlet port;

wherein said fill ports traverse said bleed bores subsequent to traversing said fluid inlet port and prior to traversing said fluid outlet port to provide a staged transition for fluid in said fill ports as said fill ports move from fluid communication with said fluid inlet port to fluid communication with said fluid outlet port;

a first bleed opening formed in said port plate between said fluid inlet port and said fluid outlet port the bleed opening having one end which opens into said port face and an other end which is in fluid communication with said fluid outlet port;

a second bleed opening formed in said port plate downstream of said first bleed port having one end which opens into said port face and an other end which opens to case; and wherein said fill ports traverse said first and second bleed openings in sequence subsequent to traversing said fluid outlet port and prior to traversing said fluid inlet port to reduce the turbulence in said fill ports as said fill ports move from fluid communication with said fluid outlet port to fluid communication with said fluid inlet port.

6. A variable displacement hydraulic axial piston machine comprising:

a body;

a barrel having a working face rotatably mounted in said body;

a drive shaft mounted in a drive shaft bore formed in said barrel for rotating said barrel;

a plurality of piston bores formed in said barrel positioned along the circumference of a piston circle;

a plurality of pistons of which one is mounted in each piston bore;

a cam support formed in said body;

a cam rotatably mounted in said cam support;

a thrust plate mounted on said cam;

a shoe pivotably attached to each piston and slideable on said thrust plate to reciprocate said pistons within said piston bores when said barrel is rotated;

pivot means for pivoting said cam between a position of minimum fluid displacement of the machine and a position of maximum fluid displacement of the machine;

a port block having a fluid inlet and a fluid outlet affixed to said housing;

a port plate interposed between the working face of said barrel and said port block and having a port face positioned adjacent said barrel working face;

wherein said port plate has an arcuate inlet port and an arcuate outlet port arranged along the circumference of a circle and aligned with said fluid inlet and said fluid outlet respectively of said port block;

a pair of bleed bores formed in said port plate between said fluid inlet port and said fluid outlet port each having one end which opens into said port face and an other end which is in fluid communication with said fluid outlet port; and wherein said piston bores traverse said bleed bores subsequent to traversing said fluid inlet port and prior to traversing said fluid outlet port to provide a staged transition for fluid in said piston bores as said piston bores move from fluid communication with said fluid inlet port to fluid communication with said fluid outlet port.

7. A variable displacement hydraulic axial piston machine comprising:

a body;

a barrel having a working face rotatably mounted in said body;

a drive shaft mounted in a drive shaft bore formed in said barrel for rotating said barrel;

a plurality of piston bores formed in said barrel positioned along the circumference of a piston circle;

a plurality of pistons of which one is mounted in each piston bore;

a cam support formed in said body;

a cam rotatably mounted in said cam support;

a thrust plate mounted on said cam;

a shoe pivotably attached to each piston and slideable on said thrust plate to reciprocate said pistons within said piston bores when said barrel is rotated;

pivot means for pivoting said cam between a position of minimum fluid displacement of the machine and a position of maximum fluid displacement of the machine;

a port block having a fluid inlet and a fluid outlet affixed to said housing;

a port plate interposed between the working face of said barrel and said port block and having a port face positioned adjacent said barrel working face;

wherein said port plate has an arcuate inlet port and an arcuate outlet port arranged along the circumference of a circle and aligned with said fluid inlet and said fluid outlet respectively of said port block;

a first bleed opening formed in said port plate between said fluid inlet port and said fluid outlet port the bleed opening having one end which opens into said port face and an other end which is in fluid communication with said fluid outlet port;

a second bleed opening formed in said port plate downstream of said first bleed port having one end which opens into said port face and an other end which opens to case; and wherein said fill ports traverse said first and second bleed openings in sequence subsequent to traversing said fluid outlet port and prior to traversing said fluid inlet port to reduce the turbulence in said fill ports as said fill ports move from fluid communication with said fluid outlet port to fluid communication with said fluid inlet port.

8. A variable displacement hydraulic axial piston machine comprising:

a body;

a barrel having a working face rotatably mounted in said body;

a drive shaft mounted in a drive shaft bore formed in said barrel for rotating said barrel;

a plurality of piston bores formed in said barrel positioned along the circumference of a piston circle;

a plurality of pistons of which one is mounted in each piston bore;

a cam support formed in said body;

a cam rotatably mounted in said cam support;

a thrust plate mounted on said cam;

a shoe pivotably attached to each piston and slideable on said thrust plate to reciprocate said pistons within said piston bores when said barrel is rotated;

pivot means for pivoting said cam between a position of minimum fluid displacement of the machine and a position of maximum fluid displacement of the machine;

a port block having a fluid inlet and a fluid outlet affixed to said housing;

a port plate interposed between the working face of said barrel and said port block and having a port face positioned adjacent said barrel working face;

wherein said port plate has an arcuate inlet port and an arcuate outlet port arranged along the circumference of a circle and aligned with said fluid inlet and said fluid outlet respectively of said port block;

a pair of bleed bores formed in said port plate between said fluid inlet port and said fluid outlet port each having one end which opens into said port face and an other end which is in fluid communication with said fluid outlet port;

wherein said piston bores traverse said bleed bores subsequent to traversing said fluid inlet port and prior to traversing said fluid outlet port to provide a staged transition for fluid in said piston bores as said piston bores move from fluid communication with said fluid inlet port to fluid communication with said fluid outlet port;

a first bleed opening formed in said port plate between said fluid inlet port and said fluid outlet port the bleed opening having one end which opens into said port face and an other end which is in fluid communication with said fluid outlet port;

a second bleed opening formed in said port plate downstream of said first bleed port having one end which opens into said port face and an other end which opens to case; and wherein said fill ports traverse said first and second bleed openings in sequence subsequent to traversing said fluid outlet port and prior to traversing said fluid inlet port to reduce the turbulence in said fill ports as said fill ports move from fluid communication with said fluid outlet port to fluid communication with said fluid inlet port.

9. A hydraulic axial piston machine comprising:

a body;

a barrel having a concave working face;

a barrel bearing mounted in said body which surrounds and rotatably mounts said barrel in said body;

a drive shaft mounted in a drive shaft bore formed in said barrel for rotating said barrel;

a plurality of piston bores formed in said barrel positioned along the circumference of a piston circle;

a plurality of pistons of which one is mounted in each piston bore;

a thrust plate mounted in said body;

a shoe pivotably attached to each piston and slideable on said thrust plate to reciprocate said pistons within said piston bores when said barrel is rotated;

a plurality of angled fill ports formed in said barrel each fill port having a first end in fluid communication with a piston bore and a fill end which opens into the working face of said barrel;

wherein said fill ends of said fill ports are positioned along the circumference of a fill circle which lies within said piston circle;

a port block having a fluid inlet and a fluid outlet affixed to said housing;

a port plate interposed between the working face of said barrel and said port block and having a convex port face positioned adjacent said barrel working face;

wherein said port plate has an arcuate inlet port and an arcuate outlet port arranged along the circumference of a circle and aligned with said fluid inlet and said fluid outlet respectively of said port block;

wherein said inlet and outlet ports of said port plate are formed along the circumference of said fill circle and aligned with said fill ends of said fill ports;

a pair of bleed bores formed in said port plate between said fluid inlet port and said fluid outlet port each having one end which opens into said port face and an other end which is in fluid communication with said fluid outlet port;

wherein said fill ports traverse said bleed bores subsequent to traversing said fluid inlet port and prior to traversing said fluid outlet port to provide a staged transition for fluid in said fill ports as said fill ports move from fluid communication with said fluid inlet port to fluid communication with said fluid outlet port;

a first bleed opening formed in said port plate between said fluid inlet port and said fluid outlet port the bleed opening having one end which opens into said port face and an other end which is in fluid communication with said fluid outlet port;

a second bleed opening formed in said port plate downstream of said first bleed port having one end which opens into said port face and an other end which opens to case; and wherein said fill ports traverse said first and second bleed openings in sequence subsequent to traversing said fluid outlet port and prior to traversing said fluid inlet port to reduce the turbulence in said fill ports as said fill ports move from fluid communication with said fluid outlet port to fluid communication with said fluid inlet port.

10. A hydraulic axial piston machine comprising:

a body;

a barrel having a working face rotatably mounted in said body;

a drive shaft mounted in a drive shaft bore formed in said barrel for rotating said barrel;

a plurality of piston bores formed in said barrel positioned along the circumference of a piston circle;

a plurality of pistons of which one is mounted in each piston bore;

a thrust plate mounted in said body;

a shoe pivotably attached to each piston and slideable on said thrust plate to reciprocate said pistons within said piston bores when said barrel is rotated;

a port block having a fluid inlet and a fluid outlet affixed to said housing;

a port plate interposed between the working face of said barrel and said port block and having a port face positioned adjacent said barrel working face;

wherein said port plate has an arcuate inlet port and an arcuate outlet port arranged along the circumference of a circle and aligned with said fluid inlet and said fluid outlet respectively of said port block;

a pair of bleed bores formed in said port plate between said fluid inlet port and said fluid outlet port each having one end which opens into said port face and an other end which is in fluid communication with said fluid outlet port to provide a staged transition for fluid in said fill ports as said fill ports move from fluid communication with said fluid inlet port to fluid communication with said fluid outlet port; and wherein said piston bores traverse said bleed bores subsequent to traversing said fluid inlet port and prior to traversing said fluid outlet port to provide a staged transition for fluid in said piston bores as said piston bores move from fluid communication with said fluid inlet port to fluid communication with said fluid outlet port.

11. A hydraulic axial piston machine comprising:

a body;

a barrel having a working face rotatably mounted in said body;

a drive shaft mounted in a drive shaft bore formed in said barrel for rotating said barrel;

a plurality of piston bores formed in said barrel positioned along the circumference of a piston circle;

a plurality of pistons of which one is mounted in each piston bore;

a thrust plate mounted in said body;

a shoe pivotably attached to each piston and slideable on said thrust plate to reciprocate said pistons within said piston bores when said barrel is rotated;

a port block having a fluid inlet and a fluid outlet affixed to said housing;

a port plate interposed between the working face of said barrel and said port block and having a port face positioned adjacent said barrel working face;

wherein said port plate has an arcuate inlet port and an arcuate outlet port arranged along the circumference of a circle and aligned with said fluid inlet and said fluid outlet respectively of said port block;

a first bleed opening formed in said port plate between said fluid inlet port and said fluid outlet port the bleed opening having one end which opens into said port face and an other end which is in fluid communication with said fluid outlet port;

a second bleed opening formed in said port plate downstream of said first bleed port having one end which opens into said port face and an other end which opens to case; and wherein said fill ports traverse said first and second bleed openings in sequence subsequent to traversing said fluid outlet port and prior to traversing said fluid inlet port to reduce the turbulence in said fill ports as said fill ports move from fluid communication with said fluid outlet port to fluid communication with said fluid inlet port.

12. A hydraulic axial piston machine comprising:

a body;

a barrel having a working face rotatably mounted in said body;

a drive shaft mounted in a drive shaft bore formed in said barrel for rotating said barrel;

a plurality of piston bores formed in said barrel positioned along the circumference of a piston circle;

a plurality of pistons of which one is mounted in each piston bore;

a thrust plate mounted in said body;

a shoe pivotably attached to each piston and slideable on said thrust plate to reciprocate said pistons within said piston bores when said barrel is rotated;

a port block having a fluid inlet and a fluid outlet affixed to said housing;

a port plate interposed between the working face of said barrel and said port block and having a port face positioned adjacent said barrel working face;

wherein said port plate has an arcuate inlet port and an arcuate outlet port arranged along the circumference of a circle and aligned with said fluid inlet and said fluid outlet respectively of said port block;

a pair of bleed bores formed in said port plate between said fluid inlet port and said fluid outlet port each having one end which opens into said port face and an other end which is in fluid communication with said fluid outlet port;

wherein said piston bores traverse said bleed bores subsequent to traversing said fluid inlet port and prior to traversing said fluid outlet port to provide a staged transition for fluid in said piston bores as said piston bores move from fluid communication with said fluid inlet port to fluid communication with said fluid outlet port;

a first bleed opening formed in said port plate between said fluid inlet port and said fluid outlet port the bleed opening having one end which opens into said port face and an other end which is in fluid communication with said fluid outlet port;

a second bleed opening formed in said port plate downstream of said first bleed port having one end which opens into said port face and an other end which opens to case; and wherein said fill ports-traverse said first and second bleed openings in sequence subsequent to traversing said fluid outlet port and prior to traversing said fluid inlet port to reduce the turbulence in said fill ports as said fill ports move from fluid communication with said fluid outlet port to fluid communication with said fluid inlet port.

13. A variable displacement hydraulic axial piston machine comprising:

a body;

a barrel having a concave working face;

a barrel bearing mounted in said body which surrounds and rotatably mounts said barrel in said body;

a drive shaft mounted in a drive shaft bore formed in said barrel for rotating said barrel;

a plurality of piston bores formed in said barrel positioned along the circumference of a piston circle;

a plurality of pistons of which one is mounted in each piston bore;

a cam support formed in said body;

a cam rotatably mounted in said cam support;

a thrust plate mounted on said cam;

a shoe pivotably attached to each piston and slideable on said thrust plate to reciprocate said pistons within said piston bores when said barrel is rotated;

pivot means for pivoting said cam between a position of minimum fluid displacement of the machine and a position of maximum fluid displacement of the machine;

a plurality of angled fill ports formed in said barrel each fill port having a first end in fluid communication with a piston bore and a fill end which opens into the working face of said barrel;

wherein said fill ends of said fill ports are positioned along the circumference of a fill circle which lies within said piston circle;

a port block having a fluid inlet and a fluid outlet affixed to said housing;

a port plate interposed between the working face of said barrel and said port block and having a convex port face positioned adjacent said barrel working face;

wherein said port plate has an arcuate inlet port and an arcuate outlet port arranged along the circumference of a circle and aligned with said fluid inlet and said fluid outlet respectively of said port block;

wherein said inlet and outlet ports of said port plate are formed along the circumference of said fill circle and aligned with said fill ends of said fill ports; and a pair of lateral side walls formed on said cam which extend transversely of said thrust plate, a pair of shoulders formed on said cam side walls, a pair of cam retainers affixed to said housing, said cam retainer being formed of a plastic material, and wherein one of said cam retainer engages each of said shoulders to retain and guide said cam in said housing.

14. A variable displacement hydraulic axial piston machine comprising:

a body;

a barrel having a concave working face;

a barrel bearing mounted in aid body which surrounds and rotatably mounts said barrel in said body;

a drive shaft mounted in a drive shaft bore formed in said barrel for rotating said barrel;

a plurality of piston bores formed in said barrel positioned along the circumference of a piston circle;

a plurality of pistons of which one is mounted in each piston bore;

a cam support formed in said body;

a cam rotatably mounted in said cam support;

a thrust plate mounted on said cam;

a shoe pivotably attached to each piston and slideable on said thrust plate to reciprocate said pistons within said piston bores when said barrel is rotated;

pivot means for pivoting said cam between a position of minimum fluid displacement of the machine and a position of maximum fluid displacement of the machine;

a plurality of angled fill ports formed in said barrel each fill port having a first end in fluid communication with a piston bore and a fill end which opens into the working face of said barrel;

wherein said fill ends of said fill ports are positioned along the circumference of a fill circle which lies within said piston circle;

a port block having a fluid inlet and a fluid outlet affixed to said housing;

a port plate interposed between the working face of said barrel and said port block and having a convex port face positioned adjacent said barrel working face;

wherein said port plate has an arcuate inlet port and an arcuate outlet port arranged along the circumference of a circle and aligned with said fluid inlet and said fluid outlet respectively of said port block;

wherein said inlet and outlet ports of said port plate are formed along the circumference of said fill circle and aligned with said fill ends of said fill ports; and a pair of bleed bores formed in said port plate between said fluid inlet port and said fluid outlet port and having one end which opens into said port face and an other end which is in fluid communication with said fluid outlet port, wherein said fill ports traverse said bleed bores subsequent to traversing said fluid inlet port and prior to traversing said fluid outlet port to provide a staged transition for fluid in said fill ports as said fill ports move from fluid communication with said fluid inlet port to fluid communication with said fluid outlet port.

15. The piston machine of claim 14 wherein the length and the diameter of said bleed bores are sized to limit the acceleration and the rate of flow of fluid therethrough.

16. A variable displacement hydraulic axial piston machine comprising:

a body;

a barrel having a concave working face;

a barrel bearing mounted in said body which surrounds and rotatably mounts said barrel in said body;

a drive shaft mounted in a drive shaft bore formed in said barrel for rotating said barrel;

a plurality of piston bores formed in said barrel positioned along the circumference of a piston circle;

a plurality of pistons of which one is mounted in each piston bore;

a cam support formed in said body;

a cam rotatably mounted in said cam support;

a thrust plate mounted on said cam;

a shoe pivotably attached to each piston and slideable on said thrust plate to reciprocate said pistons within said piston bores when said barrel is rotated;

pivot means for pivoting said cam between a position of minimum fluid displacement of the machine and a position of maximum fluid displacement of the machine;

a plurality of angled fill ports formed in said barrel each fill port having a first end in fluid communication with a piston bore and a fill end which opens into the working face of said barrel;

wherein said fill ends of said fill ports are positioned along the circumference of a fill circle which lies within said piston circle;

a port block having a fluid inlet and a fluid outlet affixed to said housing;

a port plate interposed between the working face of said barrel and said port block and having a convex port face positioned adjacent said barrel working face;

wherein said port plate has an arcuate inlet port and an arcuate outlet port arranged along the circumference of a circle and aligned with said fluid inlet and said fluid outlet respectively of said port block;

wherein said inlet and outlet ports of said port plates are formed along the circumference of said fill circle and aligned with said fill ends of said fill ports; and a first bleed opening formed in said port plate between said fluid inlet port and said fluid outlet port and having one end which opens into said port face and an other end which is in fluid communication with said fluid outlet port and a second bleed opening formed in said port plate downstream of said first bleed port having one end which opens into said port face and an other end which opens to case wherein said fill ports traverse said first and second bleed openings in sequence subsequent to traversing said fluid outlet port and prior to traversing said fluid inlet port to reduce the turbulence in said fill ports as said fill ports move from fluid communication with said fluid outlet port to fluid communication with said fluid inlet port.

17. The hydraulic axial piston machine of claim 16 wherein the length and the diameter of said first and second bleeding openings are sized to limit the acceleration and the rate of fluid flow therethrough.

18. A variable displacement hydraulic axial piston machine comprising:

a body;

a barrel having a concave working face;

a barrel bearing mounted in said body which surrounds and rotatably mounts said barrel in said body;

a drive shaft mounted in a drive shaft bore formed in said barrel for rotating said barrel;

a plurality of piston bores formed in said barrel positioned along the circumference of a piston circle;

a plurality of pistons of which one is mounted in each piston bore;

a thrust plate mounted on said cam;

a shoe pivotably attached to each piston and slideable on said thrust plate to reciprocate said pistons within said piston bores when said barrel is rotated;

a plurality of angled fill ports formed in said barrel each fill port having a first end in fluid communication with a piston bore and a fill end which opens into the working face of said barrel;

wherein said fill ends of said fill ports are positioned along the circumference of a fill circle which lies within said piston circle;

a port block having a fluid inlet and a fluid outlet affixed to said housing;

a port plate interposed between the working face of said barrel and said port block and having a convex port face positioned adjacent said barrel working face;

wherein said port plate has an arcuate inlet port and an arcuate outlet port arranged along the circumference of a circle and aligned with said fluid inlet and said fluid outlet respectively of said port block;

wherein said inlet and outlet ports of said port plate are formed along the circumference of said fill circle and aligned with said fill ends of said fill ports; and a pair of bleed bores formed in said port plate between said fluid inlet port and said fluid outlet port and having one end which opens into said port face and an other end which is in fluid communication with said fluid outlet port, wherein said fill ports traverse said bleed bores subsequent to traversing said fluid inlet port and prior to traversing said fluid outlet port to provide a staged transition for fluid in said fill ports as said fill ports move from fluid communication with said fluid inlet port to fluid communication with said fluid outlet port.

19. The piston machine of claim 18 wherein the length and the diameter of said bleed bores are sized to limit the acceleration and the rate of flow of fluid therethrough.

20. A variable displacement hydraulic axial piston machine comprising:

a body;

a barrel having a concave working face;

a barrel bearing mounted in said body which surrounds and rotatably mounts said barrel in said body;

a drive shaft mounted in a drive shaft bore formed in said barrel for rotating said barrel;

a plurality of piston bores formed in said barrel positioned along the circumference of a piston circle;

a plurality of pistons of which one is mounted in each piston bore;

a thrust plate mounted on said cam;

a shoe pivotably attached to each piston and slideable on said thrust plate to reciprocate said pistons within said piston bores when said barrel is rotated;

a plurality of angled fill ports formed in said barrel each fill port having a first end in fluid communication with a piston bore and a fill end which opens into the working face of said barrel;

wherein said fill ends of said fill ports are positioned along the circumference of a fill circle which lies within said piston circle;

a port block having a fluid inlet and a fluid outlet affixed to said housing;

a port plate interposed between the working face of said barrel and said port block and having a convex port face positioned adjacent said barrel working face;

wherein said port plate has an arcuate inlet port and an arcuate outlet port arranged along the circumference of a circle and aligned with said fluid inlet and said fluid outlet respectively of said port block;

wherein said inlet and outlet ports of said port plate are formed along the circumference of said fill circle and aligned with said fill ends of said fill ports; and a first bleed opening formed in said port plate between said fluid inlet port and said fluid outlet port and having one end which opens into said port face and an other end which is in fluid communication with said fluid outlet port and a second bleed opening formed in said port plate downstream of said first bleed port having one end which opens into said port face and an other end which opens to case wherein said fill ports traverse said first and second bleed openings in sequence subsequent to traversing said fluid outlet port and prior to traversing said fluid inlet port to reduce the turbulence in said fill ports as said fill ports move from fluid communication with said fluid outlet port to fluid communication with said fluid inlet port.

21. The hydraulic axial piston machine of claim 20 wherein the length and the diameter of said first and second bleeding openings are sized to limit the acceleration and the rate of fluid therethrough.

* * * * *